United States Patent [19]

Humphrey et al.

[11] 4,068,777

[45] Jan. 17, 1978

[54] EXPANSIBLE BOTTOM STRUCTURE FOR FIBERGLASS REINFORCED PLASTIC TANKS

[75] Inventors: Frederick H. Humphrey, Markham, Canada; James J. Jarvis, Snyder, N.Y.

[73] Assignee: Metal-Cladding, Inc., North Tonawanda, N.Y.

[21] Appl. No.: 635,067

[22] Filed: Nov. 25, 1975

[51] Int. Cl.[2] ..... B65D 25/24

[52] U.S. Cl. ..... 220/1 B; 52/224; 52/247; 220/5 A; 220/18; 220/69

[58] Field of Search ..... 220/69, 1 B, 18, 5 A, 220/9 A, 9 LG, 80, 81; 52/247, 224

[56] References Cited

U.S. PATENT DOCUMENTS

| | | | |
|---|---|---|---|
| 2,824,664 | 2/1958 | French et al. | 220/81 R |
| 2,899,820 | 8/1959 | Headrick | 220/1 B |
| 3,025,992 | 3/1962 | Humphrey | 220/71 |
| 3,047,184 | 7/1962 | Van Bergen et al. | 220/18 |
| 3,150,794 | 9/1964 | Schlumberger et al. | 220/9 LG |
| 3,275,181 | 9/1966 | Leclou | 220/18 |
| 3,423,264 | 1/1969 | Miron et al. | 52/247 |
| 3,545,640 | 12/1970 | Delahunt | 220/5 A |
| 3,700,512 | 10/1972 | Pearson et al. | 220/5 A |
| 3,833,944 | 9/1974 | Goettl et al. | 52/247 |
| 3,917,104 | 11/1975 | Rossitto et al. | 220/9 LG |

*Primary Examiner*—William Price
*Assistant Examiner*—Allan N. Shoap
*Attorney, Agent, or Firm*—Sommer & Sommer

[57] ABSTRACT

An expansible bottom structure for a fiberglass reinforced plastic tank allows a lower portion of the tank side wall structure to expand radially outwardly without significant deformation of its original shape.

The improvement includes a fiberglass reinforced plastic batten having an upper portion bonded to the cylindrical side wall of a tank, a lower portion bonded to the bottom of the tank, and an intermediate arcuate transitional portion adapted to flex under tension to a less arcuate position. Such permissible flexure of the batten transitional portion enables the tank side wall structure to expand radially outwardly under hydrostatic load, while preserving substantially undeformed the desired shape and characteristics of the lower portion of the side wall structure. The batten provides the sole fluid-containing connection between the side wall structure and the tank bottom.

7 Claims, 5 Drawing Figures

EXPANSIBLE BOTTOM STRUCTURE FOR FIBERGLASS REINFORCED PLASTIC TANKS

BACKGROUND OF THE INVENTION

1. Field of the Invention

The present invention relates generally to a significant improvement in cable-wrapped fiberglass reinforced plastic tanks adapted to store a contained fluid, and more particularly to an improved expansible bottom structure for permitting the side wall of the tank to expand radially outwardly under hydrostatic load.

2. Description of the Prior Art

U.S. Pat. No. 3,025,992 discloses a basic fiberglass reinforced plastic (FRP) tank wherein a steel cable is helically wound around the FRP side wall of the tank to absorb the hoop stress produced by a head of stored fluid.

U.S. patent application Ser. No. 448,669, filed Mar. 6, 1974, discloses two improvements in such cable-wrapped FRP tanks. The first improvement provides a unique top ring girder adapted to resist deformation of an upper portion of the side wall structure, when the tank is empty, due to wind loading. The second improvement provides a unique bottom ring girder designed to slide relative to a supporting foundation, and to resist an overturning moment applied to the tank.

SUMMARY OF THE INVENTION

The present invention provides a unique improvement in an upstanding fiberglass reinforced plastic tank which is adapted to receive and store a fluid exposed to atmospheric pressure. The tank has a bottom resting on a support, and a separate annular side wall structure terminating in a lowermost "foot", also resting on the support. When filled with a fluid, the head of such stored fluid exerts a hydrostatic pressure on the side wall of the tank which urges the side wall to expand outwardly or strain in a radial direction.

The inventive improvement provides novel means for joining the bottom and side wall structure to accommodate such radial expansion due to such hydrostatic load. Broadly, the means comprises an FRP batten having an upper portion bonded to the side wall structure, a lower portion bonded to the tank bottom, and an intermediate acruate transitional portion adapted to flex under tension during such radial expansion, such that the "foot" may slide outwardly along the support without significant deformation of its original shape.

The "foot" may be separated from the tank bottom, and the FRP batten may provide the sole fluid-containing connection between the bottom and side wall structure. In one embodiment, a fillet, constructed of a material to which the bonding resin will not adhere, is positioned between the "foot" and the tank bottom, with the batten transitional portion being formed to assume the contour of this fillet. During radial strain of the side wall structure, the transitional portion is tensioned to a less arcuate shape, and may lift-off and separate from said fillet, this permissible flexure of the transitional portion accommodating such radial expansion of the side wall structure.

Accordingly, one object of the present invention is to provide a highly advantageous improvement for such cable-wrapped FRP tanks, particularly those tanks of large diameter, to permit such radial expansion of the side wall structure.

Another object is to permit such radial expansion of the side wall structure without significantly deforming the shape of the "foot".

Another object is to provide an improvement in a cable-wrapped FRP tank to prevent breakage or fracture of the tank during such radial expansion of the side wall structure.

Still another object is to provide an improvement in a cable-wrapped FRP tank to permit radial expansion of the side wall structure, while preserving without significant deformation, the original shape of a lower portion of the side wall structure.

These and other objects and advantages will become apparent from the foregoing and ongoing specification, the drawings and the appended claims.

BRIEF DESCRIPTION OF THE DRAWING FIGURES

DESCRIPTION OF THE PREFERRED EMBODIMENTS

Figure 1:
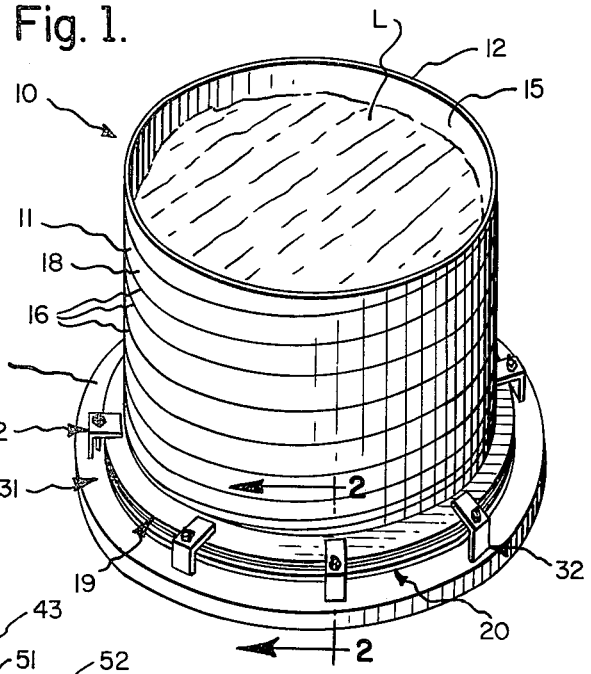
FIG. 1 is a perspective exterior view of an upstanding open-top cable-wrapped fiberglass reinforced plastic tank containing a stored liquid, this view also showing one embodiment of the anchorage means spaced circumferentially about the base of the side wall structure.

At the outset, it should be clearly understood that like reference numerals are intended to identify the same elements and/or structure consistently throughout the several drawing figures, as such elements and/or structure may be further described or explained by the entire written specification of which this detailed description is an integral part.

The present invention generally provides a significant improvement in upstanding fiberglass reinforced plastic tanks, particularly those of large diameter, of the general type disclosed in U.S. Pat. No. 3,025,992 and pending application Ser. No. 448,669, filed Mar. 6, 1974, now U.S. Pat. No. 3,917,104, issued Nov. 4, 1975, the aggregate disclosures of which are hereby incorporated by reference.

Referring initially to FIG. 1, an upstanding open-top fiberglass reinforced plastic tank, generally indicated at 10, is depicted as including an annular side wall structure 11 terminating in an annular rim 12 at its upper end, and a horizontal circular plate-like bottom 13 (FIG. 2) resting on a lower concrete foundation or support 14 and having a diameter less than that of the side wall structure. Conventionally, the various component parts of tank 10 are formed of a fiberglass reinforced plastic (FRP) material to provide a high degree of corrosion resistance to various liquids and fluid materials which may be stored therein. Such FRP material may typically include alternate layers of high strength woven roving and 1½ oz. fibrous mat, and one or more inner layers of surfacing mat, such as C-glass, all of such layers being bonded together with a suitable resin, such as polyester, epoxy, phenolic, furfuryl alcohol, vinylester or other suitable plastic, to form a monolithic structure.

Since the modulus of elasticity for such FRP material is relatively low, being in the order of $1.0 \times 10^6$ psi in tension and $1.25 \times 10^6$ psi in compression and decreases with time, the side wall structure 11 of the tank must be further strengthened to resist the hoop stress exerted by the height or head of stored liquid (L) acting normal to the inner surface 15 of the side wall structure. To this end, a steel cable 16 having a greater modulus of elasticity, typically in the order of $21 \times 10^6$ psi, has its lower end suitably anchored (as hereinafter described) proximate the bottom of the tank, its intermediate portion helically wound around the outer surface 18 of the side wall structure such that the vertical spacing between adjacent cable convolutions increases with height above the tank bottom, and its upper end (not shown) suitably secured proximate the upper rim 12 of the side wall structure. This helically-wound cable 16 is initially wrapped snugly around the outer surface 18 of the side wall structure, and is designed to resist the hoop stress exerted by the serviced fluid on the side wall structure when the head of such fluid causes the side wall structure to expand or bulge outwardly in a radial direction.

Figure 2:
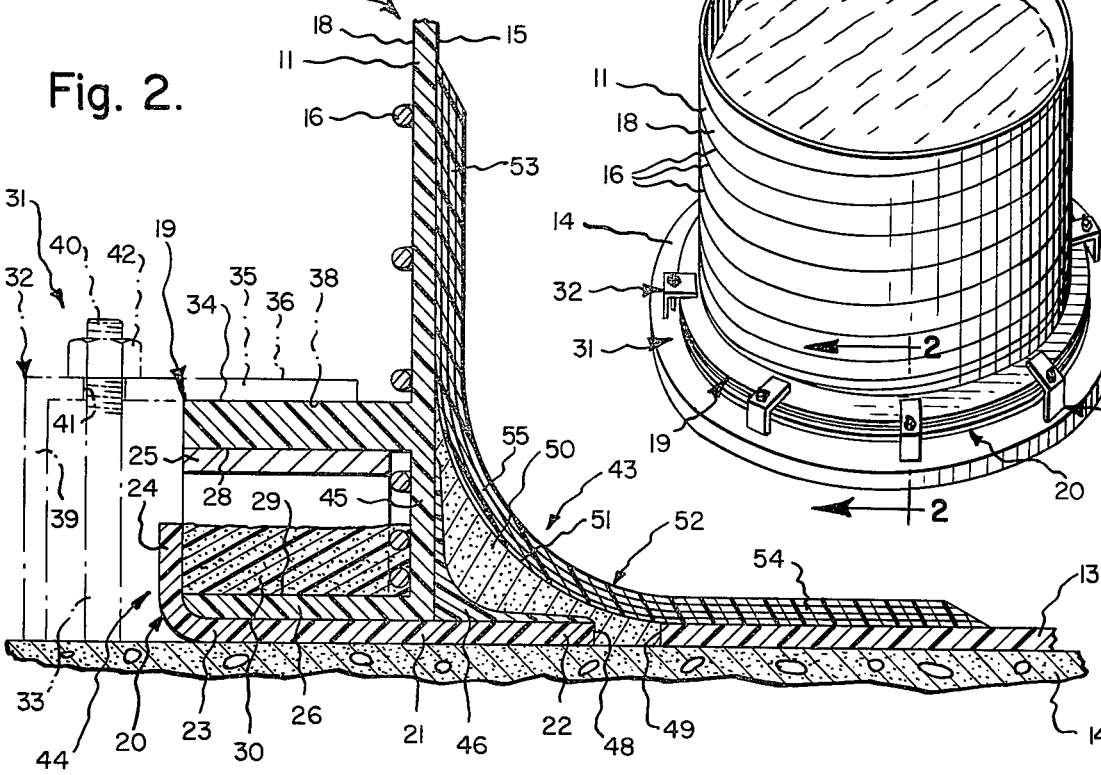
FIG. 2 is a fragmentary vertical sectional view thereof, taken generally on line 2—2 of FIG. 1, showing the annular side wall structure, the tank bottom, the "foot", and the anchorage means, and further showing one preferred embodiment of the FRP batten bonded to the sidewall structure and the bottom and resting on the arcuate surface of the lower fillet before radial expansion.

Referring now collectively to FIGS. 1 and 2, the particular tank illustrated is shown further provided with an annular horizontal upper flange 19 extending radially outwardly from a lower portion of the side wall structure, and an annular horizontal lower flange 20 extending radially outwardly from the lowermost portion of the side wall structure and adapted to rest on support 14. This lower flange 20 is specifically shown as including a lower annular horizontal plate-like member 21 having an intermediate portion underlying side wall structure 11, an inner portion 22 extending radially inwardly, and an outer portion 23 extending radially outwardly and terminating in an outermost upstanding cylindrical portion 24 spaced radially from the side wall structure.

A plurality of inverted U-shaped stiffening members 25 are spaced circumferentially about the side wall structure to have their vertical leg portions rest on the out-turned radially-extending lower flange portion 26 of the side wall structure, and have their upper horizontal web portions supportively engage the lower surface 28 of the upper flange 19.

The outer upstanding cylindrical portion 24 of the aggregate lower flange 20 forms with the lower portion of the side wall structure, an annular trough 29 which may be filled with a suitable resin-sand mixture 30 in which the lower end of cable 16 may be embedded and anchored.

The anchorage means 31 broadly includes a plurality of circularly-spaced inverted L-shaped angle sections 32, and a corresponding plurality of anchor bolt assemblies 33 suitably embedded in the concrete foundation 14 and arranged to act on the upper surface 34 of the upper flange 19. Each angle section 32 includes a horizontal plate portion 35 having an upper surface 36 arranged to be acted upon by one of the anchor bolts, and a lower surface 38 contacting or engaging the upper surface 34 of the upper flange 19 for distributing the downward force exerted by the anchor bolt assembly over the area of contact between plate portion 35 and upper flange upper surface 34; and further includes an integral vertical leg portion 39 depending from an outermost part of plate portion 35 and having a lower end arranged to engage or contact a portion of foundation support 14. Each anchor bolt assembly 33 has a lower hooked end (not shown) suitably embedded or otherwise secured in foundation 14, and a vertical threaded upper end portion 40 arranged to penetrate a hole 41 provided through plate portion 35. A nut 42 is threaded onto the anchor bolt threaded end portion 40. Each of the nuts 42 may be suitably tightened to cause the angle section plate portion 35 to exert the desired downward force on the upper flange 19. For convenience, the anchorage means 31 has been depicted in phantom in FIGS. 2–5 to illustrate an environment in which the present invention may be employed, but without confusion of structure.

It will be appreciated that if the annular side wall structure 11 were secured directly to the tank bottom 13, as disclosed in the aforesaid U.S. Pat. No. 3,025,992 and pending application Ser. No. 448,669, filed Mar. 6, 1974, the outward force exerted by a hydrostatic load of stored fluid would urge the side wall structure to expand or bulge radially outwardly with a possible delitescent effect of distorting the shape of the lower portion of the side wall structure or otherwise interfering with the sliding relationship between the upper flange 19 and the anchorage means 31.

Figure 3:
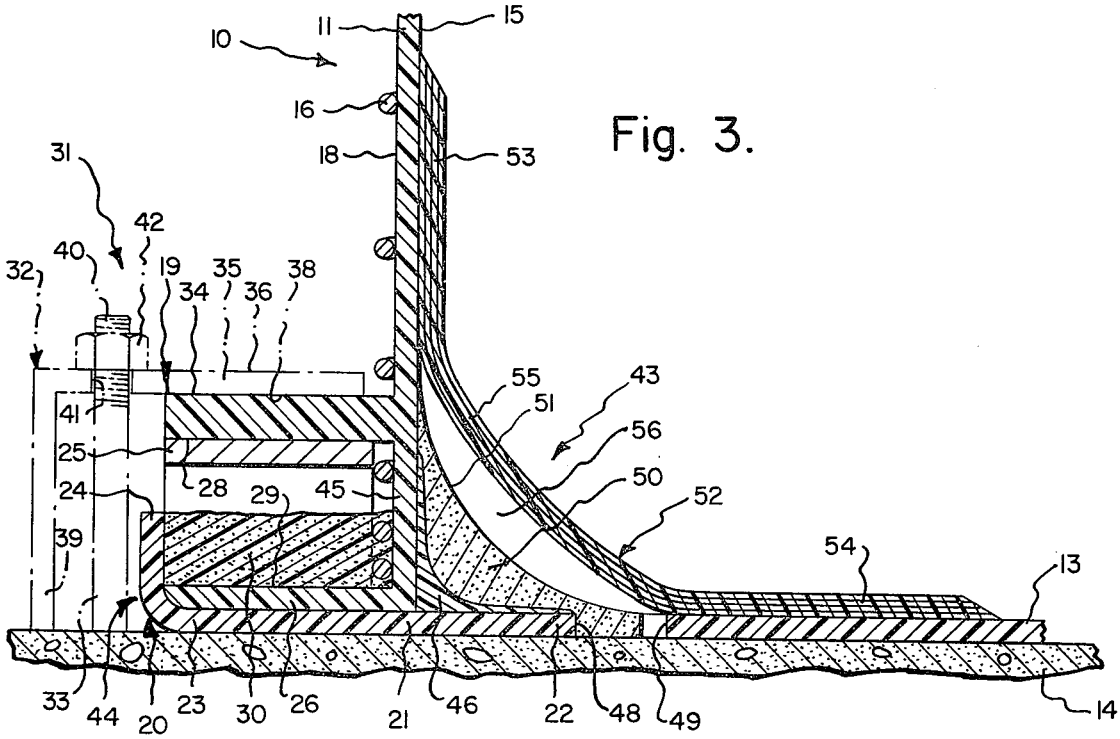
FIG. 3 is a fragmentary vertical sectional view thereof, generally similar to FIG. 2, but showing the position of the "foot" and the "diaphragming effect" of the batten transitional portion when the side wall structure expands radially outwardly.

First Preferred Embodiment (FIGS. 2 and 3)

To accommodate such radial strain of the side wall structure under hydrostatic load, while preserving the sliding relationship of the lower portion of the side wall structure with the anchorage means and the support, the present invention provides means, generally indicated at 43, for joining the tank side wall structure 11 with the tank bottom 13 to permit or accommodate radial expansion or strain of the side wall structure due to such hydrostatic load, while preserving substantially undeformed the shape of the lower portion of the side wall structure.

For convenience, the lower portion of the side wall structure will be termed a "foot". Specifically, this "foot", generally indicated at 44, includes a lower portion 45 of the side wall structure, the upper flange 19, the lower flange 20, and the bonding fillet 46 used to join the side wall structure lower portion 45 to the lower annular plate-like member 21.

Adverting now particularly to FIG. 2, it will be seen that the innermost vertical end face 48 of plate-like member 21 is separated and spaced from the outermost vertical cylindrical end face 49 of the bottom 13, such that the "foot" may move slidably along foundation 14 independently of the bottom. As shown, the opposing end faces 48, 49 are separated by a distinct gap merely for convenience in manufacturing, although such disjointed end faces could alternatively abut one another if desired.

A corner fillet 50 is shown formed against the bonding fillet and arranged in the gap between opposing faces 48, 49. This ring-like corner fillet 50 is further formed to have an arcuate surface 51 arranged to face upwardly and inwardly into the tank. While specifically shown to be formed of common motar, this corner fillet may be constructed of any suitable material to which the bonding resin will not adhere, and such fillet may be formed as an integral ring or in discrete segments, as desired. Moreover, the fillet arcuate surface 51 may be formed, in cross-section, as a segment of a cylinder, a hyperbola, a parabola, or any other arcuate shape of known or created curvature.

The means 43, joining tank bottom 13 with tank side wall structure 11 for permitting such radial expression, comprises a laminated batten 52 of fiberglass reinforced plastic material having an upper portion 53 suitably bonded to the side wall structure 11 above the lowermost "foot" 44 thereof, a lower portion 54 suitably bonded to the tank bottom 13, and an intermediate arcuate transitional portion 55 originally formed to the contour of fillet surface 51 and adapted to flex or bend during radial expansion of the side wall structure. Thus, by virtue of the upper and lower portions 53, 54 being bonded to the side wall structure 11 and bottom 13, respectively, to form a monolithic tank structure, it will be appreciated that the batten 52 provides the sole fluid-containing connection between the side wall 11 and bottom 13 of the tank.

The operation or flexure of batten 52 may be appreciated by a visual comparison of the structure shown in FIGS. 2 and 3, the latter figure illustratively depicting the position of the various structural parts when the head of a stored fluid causes radial strain of the side wall structure 11.

In FIG. 3, the side wall structure 11 is shown displaced leftwardly along the supporting foundation 14, relative to the anchorage means 31 and the tank bottom 13. As an example, under actual conditions, a cable-wrapped FRP tank having a nominal diameter of about 72 feet may experience radial strain on the order of one-quarter inch, this depending on a number of variant factors.

In FIG. 3, the sliding relationship of the upper and lower flanges 19, 20 to the anchorage means 31 and foundation 14, respectively, accommodates the radial strain of the side wall structure. However, during such expansion, the transitional portion 55 of batten 52 may flex or bend from its original position (FIG. 2) to a less arcuate position, such as that respresentatively shown in FIG. 3. Indeed, the transitional portion 55 may lift-off or separate from the non-adhering corner fillet surface 51 such that an air gap 56 (FIG. 3) may be created between transitional position 55 and corner fillet surface 51. Thus, the outwardly-displaced side wall structure 11 may tension the transitional portion 55 to lessen its degree of curvature and cause this "diaphragming effect" of separation from the fillet surface 51.

Figure 4:
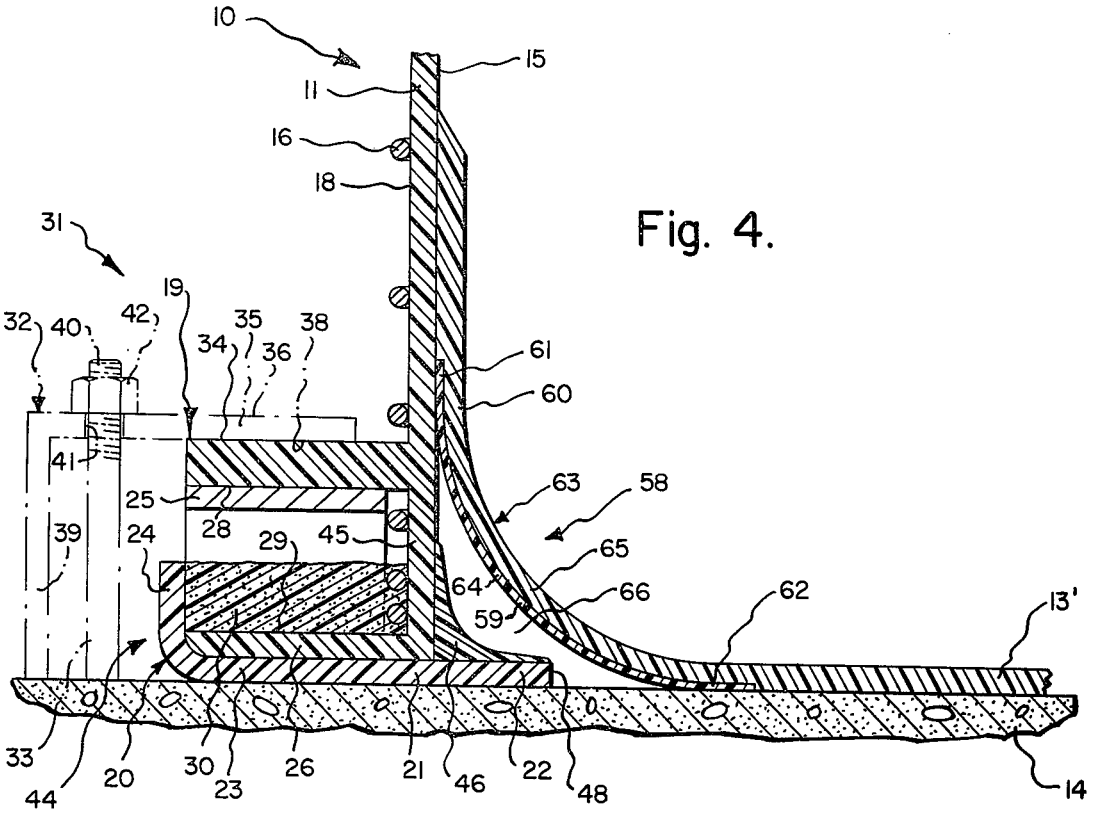
FIG. 4 is a fragmentary vertical sectional view, generally similar to FIG. 2, but showing a second preferred embodiment of the batten in the position as formed.
Figure 5:
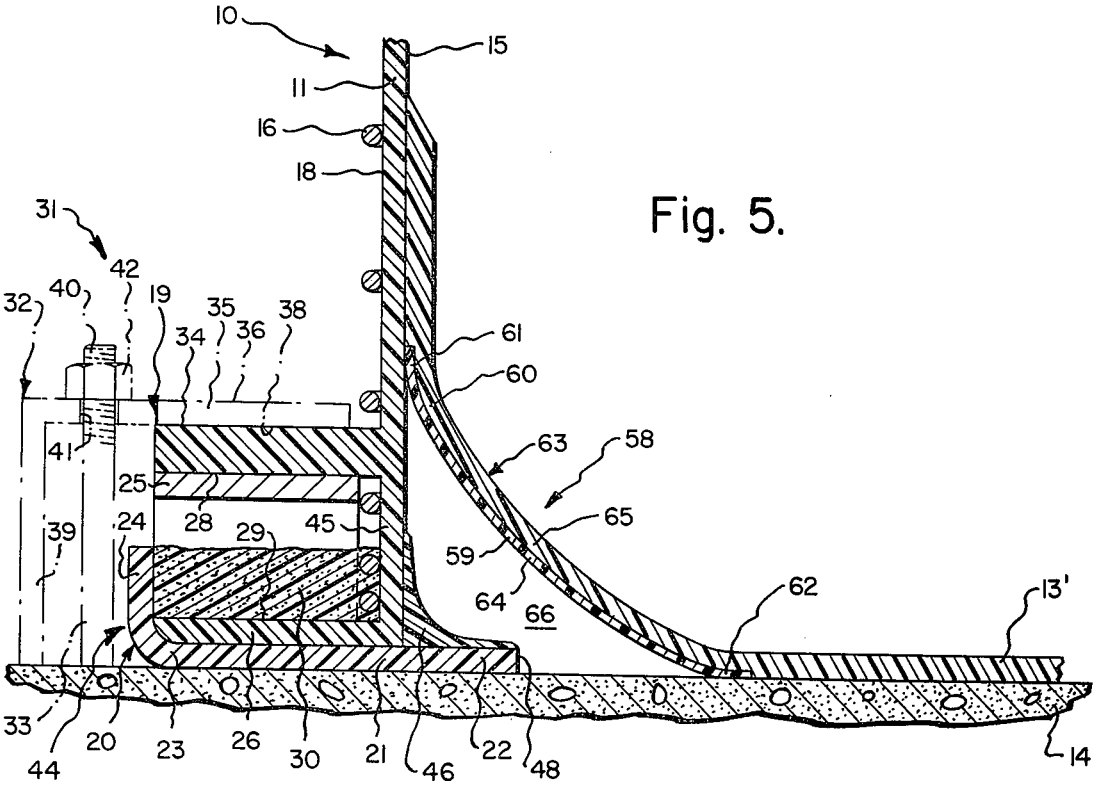
FIG. 5 is a fragmentary vertical sectional view thereof, generally similar to FIG. 4, but showing the tensioned condition of the second batten embodiment when the side wall structure expands radially outwardly.

Second Preferred Embodiment (FIGS. 4-5)

The views of FIGS. 4 and 5 are generally similar to the views of FIGS. 2 and 3, except for substitution of the second preferred embodiment of the means, generally indicated at 58, for joining the tank side wall structure 11 with the tank bottom 13' for the function heretofore described.

In this second preferred embodiment, the means 58 comprises a pre-molded thin shell 59 of FRP material, and a marginal portion 60 of the tank bottom 13'.

The shell 59 may be pre-molded to have a quarter-round (FIG. 4) or other arcuate cross-sectional shape; and is placed to have its upper portion 61 tangentially contact the side wall structure 11 above the "foot" 44, and to have its lower portion 62 tangentially contact the upper surface of the foundation 14. If desired, this shell 59 may be integrally formed as one continuous circular ring, or as a plurality of segments thereof later assembled or positioned to simulate such ring.

Thereafter, the outermost annular marginal portion 60 of bottom 13' is bonded to the shell 59 and to the side wall structure 11 to form a monolithic structure. Thus, the principle difference between the first and second preferred embodiments disclosed herein lies in their structure and method of manufacture, but not in their method of operation.

FIG. 5 illustrates the position of structure when the outward radial strain of the side wall structure has tensioned the second embodiment arcuate transitional portion 63, shown as comprising the transitional portion 64 of the shell and the transitional portion 65 of the bottom marginal portion 60.

One principal advantage of this second embodiment is the elimination of the mortared corner fillet 50, leaving a space 66 between the transitional portion 63 and the "foot" 44. Otherwise, the operation of the first and second embodiments is the same.

Therefore, it will be appreciated that, with both preferred embodiments herein disclosed, the inventive means joins the tank bottom with the tank side wall structure and permits radial expansion of the side wall structure while preserving substantially undeformed the original operative shape of the "foot".

Moreover, since such FRP material may be bonded together in any of a plurality of ways to produce a resultant monolithic structure, the specific structure of the "foot" may be readily modified by persons skilled in this art. In other words, the term "foot", as used herein, is intended in a generic sense to include any type of specially configured member, not limited to the particular species herein illustrated and described. Similarly, the configuration or method of formation of any of the various FRP parts and components may be varied, as desired. Of course, in the first embodiment, the corner fillet 50 may be suitably constructed of any suitable material to which the bonding resin will not adhere, so as to preserve the ability of the transitional portion 55 to "diaphragm" or separate from fillet surface 51 to accommodate such radial strain. If desired, the corner fillet surface 51 may be coated with a suitable non-adhering material or substance to accomplish this function.

While two presently preferred embodiments of the present invention have been shown and described, it will be appreciated by persons skilled in this art that various additional changes and modifications may be made without departing from the spirit of the invention which is generically defined by the following claims.

What is claimed is:

1. An upstanding fiberglass reinforced plastic tank adapted to receive and store a fluid exposed to atmospheric pressure, said tank having a bottom resting on a support and having an annular side wall structure, the head of a fluid stored within said tank exerting hydrostatic pressure on said side wall structure which urges said side wall structure to expand outwardly in a radial direction, wherein the improvement comprises:

movable means forming a slidable foot at a lowermost portion of said side wall structure for permitting radial expansion of a lower portion of said side wall structure due to hydrostatic pressure of a stored fluid, said slidable foot including a portion having a surface resting on and unattached to said support and substantially coplanar with the lower surface of the tank bottom, said foot being separated from said tank bottom; and joining means interconnecting said tank bottom and side wall structure, said joining means including annular batten means formed of fiberglass reinforced plastic material and having an upper portion bonded to said side wall structure, having a lower portion bonded to said tank bottom, and having an intermediate transitional portion adapted to flex during such radial expansion of said side wall structure;

whereby, during such radial expansion, said slidable foot may slide outwardly along said support without significant deformation of its original shape.

2. The improvement as set forth in claim 1 wherein said batten provides the sole fluid-containing connection between said bottom and side wall structure.

3. The improvement as set forth in claim 1 wherein said transitional portion is arcuate.

4. The improvement as set forth in claim 3 wherein said transitional portion becomes less arcuate as said side wall structure expands radially.

5. The improvement as set forth in claim 1 and further comprising a contoured fillet, constructed of a material to which bonding resin will not adhere, positioned between said foot and said bottom, and wherein said transitional portion is initially formed to the contour of said fillet.

6. The improvement as set forth in claim 5 wherein said transitional portion is adapted to separate from said fillet during such radial expansion of said side wall structure.

7. The improvement as set forth in claim 1 wherein said batten includes a thin shell and a marginal portion of said bottom bonded together to form a monolithic structure.

* * * * *